US006767158B1

(12) United States Patent
Consolazio et al.

(10) Patent No.: US 6,767,158 B1
(45) Date of Patent: Jul. 27, 2004

(54) PORTABLE ROADWAY BARRIER

(75) Inventors: Gary R. Consolazio, Gainesville, FL (US); Kurtis Robert Gurley, Gainesville, FL (US); Ralph D. Ellis, Gainesville, FL (US)

(73) Assignee: University of Florida, Gainesville, FL (US)

( * ) Notice: Subject to any disclaimer, the term of this patent is extended or adjusted under 35 U.S.C. 154(b) by 0 days.

(21) Appl. No.: 10/341,144

(22) Filed: Jan. 13, 2003

(51) Int. Cl.[7] ..... E01F 13/00
(52) U.S. Cl. ..... 404/6; 404/7
(58) Field of Search ..... 256/13.1; 404/6, 404/7

(56) References Cited

U.S. PATENT DOCUMENTS 4,844,652 A * 7/1989 Schroughan ..... 404/6
4,986,042 A * 1/1991 Richardt ..... 52/102
5,011,325 A * 4/1991 Antonioli ..... 404/6
5,074,704 A * 12/1991 McKay ..... 404/6
5,123,773 A * 6/1992 Yodock ..... 404/6
5,134,817 A * 8/1992 Richardt ..... 52/102
5,156,485 A * 10/1992 Ivey et al. ..... 404/6
5,286,136 A * 2/1994 Mandish et al. ..... 404/6
5,292,467 A * 3/1994 Mandish et al. ..... 264/112

OTHER PUBLICATIONS

Guidry et al., "Development of a Low–Profile Portable Concrete Barrier," Texas Transportation Institute, Research Report No. 990–4F, 1991.
Guidry et al., "Development of a Low–Profile Portable Concrete Barrier," Transportation Research Record, 36–46.

* cited by examiner

*Primary Examiner*—Gary S. Hartmann
(74) *Attorney, Agent, or Firm*—Akerman Senterfitt

(57) ABSTRACT

A low-profile roadway barrier for preventing vehicles from entering work zones by redirecting the vehicles back onto a roadway. The roadway barrier is formed from an elongated body having an impact surface for receiving the forces generated by a vehicle colliding with the roadway barrier. The roadway barrier may also include a key and keyway design for connecting adjacent roadway barriers together and transferring forces generally orthogonal to the elongated body to adjacent roadway barriers. The roadway barrier may have a support bracket coupled to the roadway barrier for transferring forces generally parallel to the elongated body to adjacent barriers.

33 Claims, 3 Drawing Sheets

PORTABLE ROADWAY BARRIER

FIELD OF THE INVENTION

This invention is directed generally to roadway barriers, and more particularly, to roadway barriers used during roadway construction for protection of roadway construction workers, construction equipment in work zones, and the traveling public.

BACKGROUND

Work zones on roadways are dangerous environments for construction personnel and vehicle operators. Traditionally, temporary barriers have been placed between vehicular travel lanes and work zones to prevent vehicles from entering the work zones. Barriers have been formed in numerous configurations and have had various degrees of success. For example, barriers have been formed from multiple concrete segments having heights between about three feet and about six feet and have been formed from continuous asphalt having a height of about eight inches.

Historically, the design of longitudinal barrier systems has focused primarily on issues such as redirection capability, minimization of vehicle intrusion into a work zone, and portability. Barrier systems must be capable of redirecting a variety of different types of vehicles in a smooth and stable manner without causing vehicle rollover. The barriers must also limit vehicle intrusion into the work zone. Barriers having high profiles with substantial mass achieve these design criteria. However, the temporary nature of most work zones also requires that the barrier systems be lightweight and portable so that the barriers can be installed, repositioned, and removed with minimal effort.

Barriers meeting most of these criteria are high profile concrete barriers having short segment lengths. The short segment lengths produce barriers that are relatively lightweight and portable, yet are strong enough to absorb the forces generated by a vehicle colliding with the segment and redirect the vehicle. Unfortunately, high profile barriers are not optimal and create additional hazards. For example, longitudinal concrete barriers possessing a relatively high height, such as between about three to about six feet, provide excellent separation of roadway traffic from roadside work zones. An errant vehicle coming into contact with these barriers is safely redirected back onto the roadway, thus protecting both the driver and construction personnel present in the work zone. However, while high profile barriers provide excellent redirection and separation capabilities, the high profile barriers can also obscure a driver's field of view of cross traffic and lead to accidents.

On the other hand, low-profile barriers having heights up to about one foot provide increased visibility but do not safely redirect vehicles away from the work zone on a consistent basis. Instead, the low-profile barriers fail to prevent vehicles from entering work zones, which in turn endangers the lives of the construction personnel working in the work zones.

Thus, a need exists for an alternative design for conventional high and low profile barriers.

SUMMARY OF THE INVENTION

This invention is a low-profile portable roadway barrier for preventing vehicles from entering work zones on roadways by redirecting the vehicles onto roadways. The roadway barrier gives a vehicle operator a greater field of vision than the field of vision available to vehicle drivers when conventional high-profile roadway barriers are used. The roadway barrier system, consisting of multiple individual roadway barriers may be configured to be easily movable to define the ever changing perimeter of a roadway work zone.

The roadway barrier may be formed from an elongated body having an impact surface for absorbing forces caused by at least one vehicle contacting the elongated body, a bottom surface for contacting a ground surface, a first end, and a second end. The roadway barrier may have an overall height between about one foot and about three feet. The roadway barrier may also include a leg coupled to the elongated body and positioned generally parallel to the elongated body for providing additional support during a collision between a vehicle and the barrier. The roadway barrier may be supported by support brackets for coupling the roadway barrier to adjacent roadway barriers. The roadway barrier transfers forces received by the elongated body to adjacent barriers using the support bracket.

The roadway barrier is configured to absorb forces generated by a vehicle colliding with the roadway barrier without significant movement of the barrier. The roadway barrier absorbs these forces by absorbing a portion of the force and transferring the remainder of the force to adjacent barriers through structures coupled to the ends of the roadway barriers. In one embodiment, roadway barriers transfer forces generally orthogonal to the impact surface to adjacent roadway barriers using one or more keys and keyways. The key may be a threaded shear pin in one embodiment, and the keyway may be a slot. The forces received by the elongated body that are generally parallel to the elongated body may be transferred to adjacent roadway barriers using a support bracket. By transferring forces imparted by a vehicle on the roadway barrier to adjacent barriers, the amount of force a roadway barrier is capable of absorbing is increased without increasing the weight of the roadway barrier. Support brackets coupled to adjacent roadway barriers may be coupled to each other using a support member, such as, but not limited to, a rod. Support brackets are configured with a high tolerance for misalignment between roadway barriers, thereby enabling the roadway barriers to be easily coupled together. In one embodiment, a support bracket may be coupled to the elongated body and to the leg of a roadway barrier.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
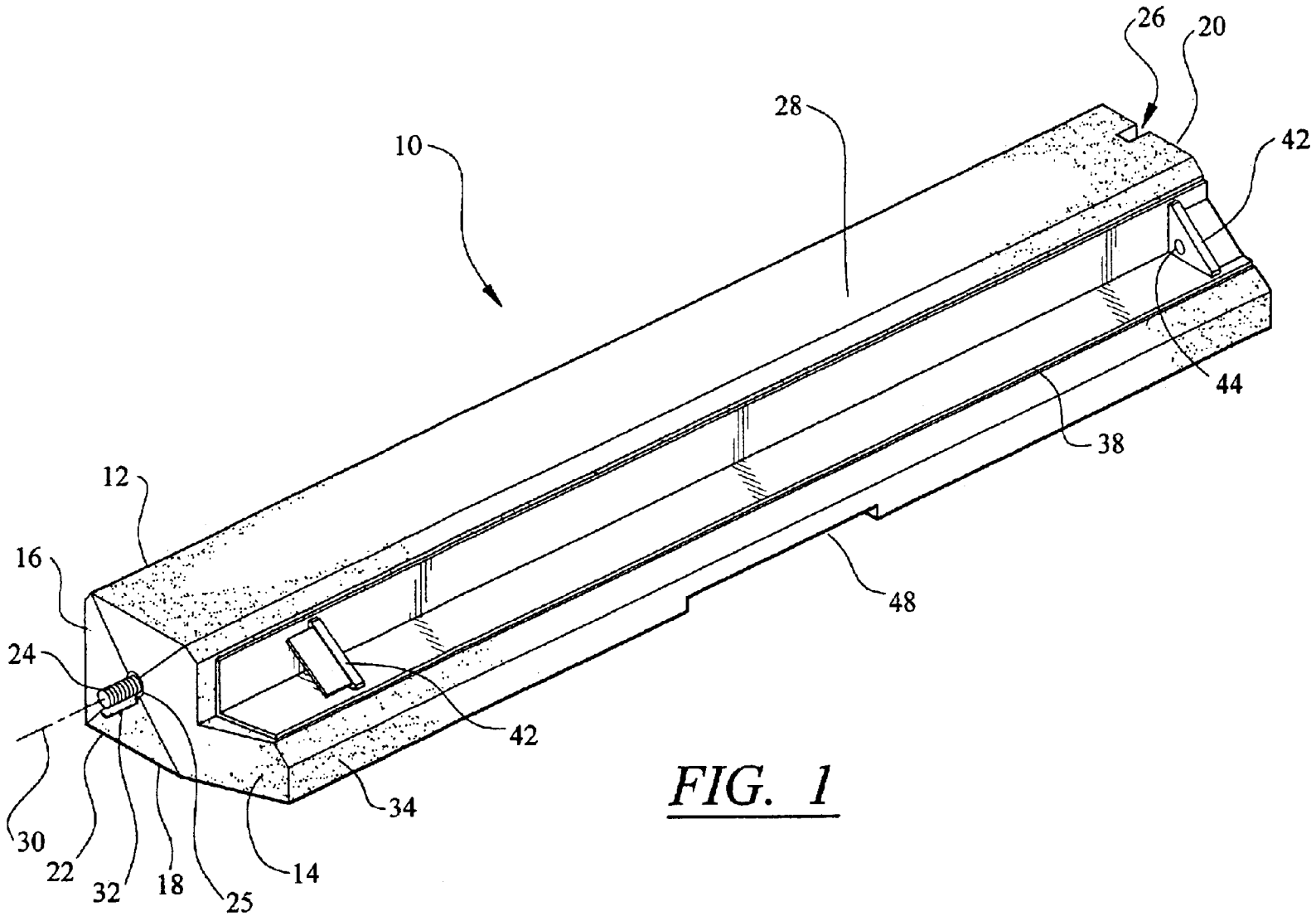
FIG. 1 is an isometric view of an exemplary embodiment of a roadway barrier of this invention.

As shown in FIG. 1, this invention is a roadway barrier 10 for preventing vehicles from entering work zones adjacent to roadways. The roadway barrier 10 is a low-profile barrier that is temporary, portable, and enables drivers of most vehicles to see over roadway barrier 10. The increased field of vision afforded vehicle drivers by using low profile roadway barrier 10 as compared with conventional high-profile barriers eliminates many dangerous situations commonly faced by drivers. Thus, using roadway barrier 10 rather than convention high-profile barriers is a safer alternative.

In one embodiment, roadway barrier 10 is composed of an elongated body 12 and a leg 14 coupled to body 12. In one embodiment, leg 14 is integrally formed with elongated body 12 as a single continuous flexible concrete structure. However, in other embodiments, leg 14 is not integrally formed with elongated body 12, but is a separate component that may be attached to elongated body 12 using mechanical connection devices, such as, but not limited to, bolts, pins, and other such devices. Leg 14 provides additional support during a collision between a vehicle and roadway barrier 10. Elongated body 12 and leg 14 may be formed from concrete, reinforced concrete, composites, and other resilient materials.

Elongated body 12 may include an impact surface 16 for absorbing forces from moving vehicles that collide with roadway barrier 10. Impact surface 16 may be a relatively flat surface or have other configurations. Impact surface 16 may be a concrete surface with a smooth or textured finish. In one embodiment, impact surface 16 is positioned relatively vertical and at about a 90 degree angle to a bottom surface 18 of body 12 upon which elongated body 12 rests. However, the position of impact surface 16 is not limited to this configuration. Rather, impact surface 16 may be positioned differently relative to bottom surface 18 or the ground upon which roadway barrier 10 rests.

Roadway barrier 10 may be configured to be included within a system of roadway barriers wherein roadway barriers 10 are coupled to each other in an end to end manner. To be used in this manner, roadway barrier 10 includes a first end 20 and a second end 22 that are configured to be attached to adjacent roadway barriers 10. First and second end, 20 and 22 respectively, may include mechanical attachment structures for coupling adjacent barriers together and for transferring forces received from vehicles colliding with a roadway barrier 10 to adjacent roadway barriers. By coupling the adjacent roadway barriers 10 together, the roadway barriers 10 act like a continuous flexible structure and can absorb greater forces without increasing the weight of each roadway barrier 10.

The mechanical attachment structures may transfer forces generally parallel and orthogonal to elongated body 12. A mechanical attachment structure may transfer a force received by the elongated body 12 that is generally orthogonal to elongated body 12. The mechanical attachment structure may include a key and keyway device. In one embodiment, the key is a shear pin 24 that is sized and configured to fit into a keyway that is a slot 26. Shear pin 24 may be a threaded rod coupled to an adapter 25, which may be attached to elongated body 12. Slot 26 may have a rectangular cross-section and may extend from a top surface 28 downwardly. Slot 26 may or may not extend downwardly until it reaches bottom surface 18. Slot 26 is sized to receive shear pin 24 and to receive shear pin 24 when a longitudinal axis 30 of shear pin 24 is generally orthogonal to slot 26 or at an angle other than 90 degrees to slot 26.

First and second ends, 20 and 22, of roadway barrier 10 may be configured similarly or differently. In one embodiment, first end 20 includes a key and second end 22 includes a keyway. In this embodiment, multiple roadway barriers 10 may be coupled together by coupling a first end 20 of a first roadway barrier 10 to a second end 22 of a second roadway barrier 10. In another embodiment, first end 20 and second end 22 of roadway barrier 10 have a key or a keyway. In this embodiment, multiple roadway barriers 10 may be coupled together when, for instance, a roadway barrier having a key at each end is placed between roadway barriers 10 having keyways at the ends of the barriers 10 facing the roadway barrier 10 having keys. In yet another embodiment, first end 20 may have a key or a keyway, while second end 22 does not include a key or keyway. This embodiment may be used as an end piece coupled to the end of a plurality of roadway barriers 10.

Figure 4A:
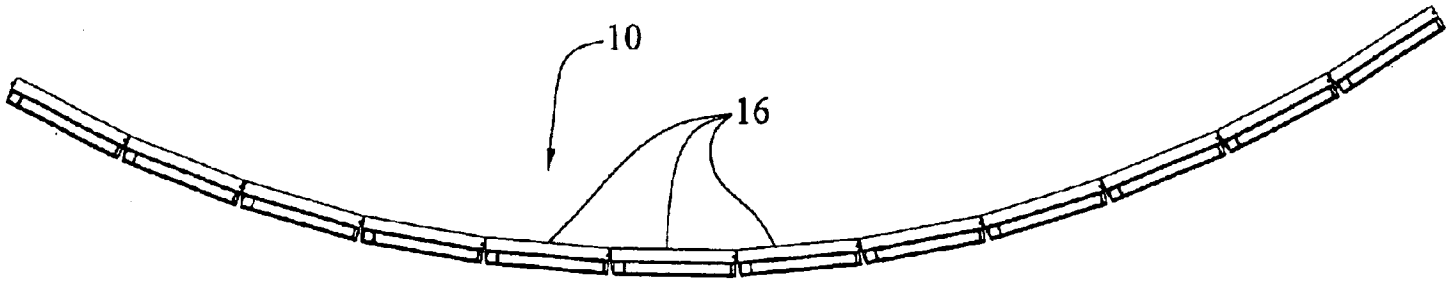
FIG. 4*a* is a top view of a plurality of roadway barriers positioned in a concave configuration and coupled together.
Figure 4B:
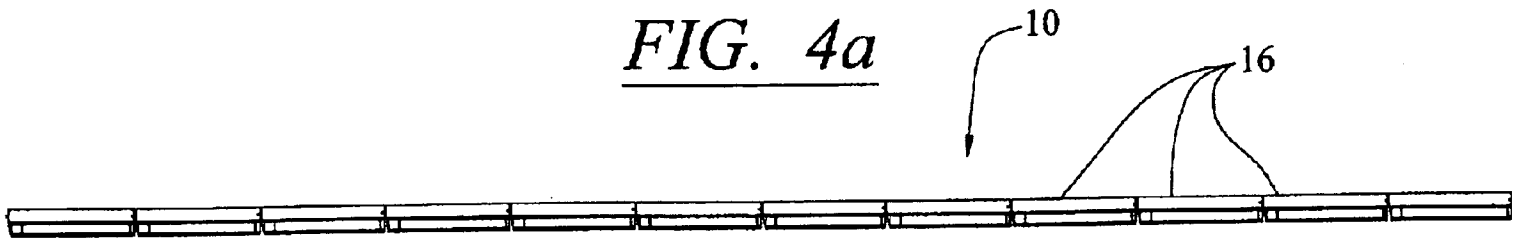
FIG. 4*b* is a top view of a plurality of roadway barriers positioned in a relatively aligned configuration and coupled together.
Figure 4C:
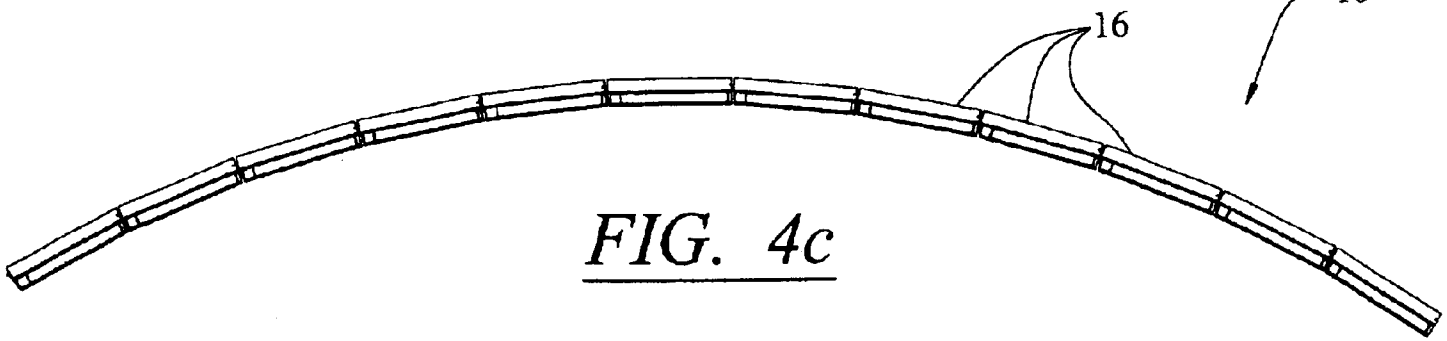
FIG. 4*c* is a top view of a plurality of roadway barriers positioned in a convex configuration and coupled together.

First end 20 may include a key, such as shear pin 24 shown in FIG. 1, and may have a convex shaped surface. More specifically, first end 20 may have a pyramidal shaped surface with shear pin 24 extending from an apex 32 of first end 20. In other embodiments, first end 20 may be conical shaped. Configuring first end 20 in this manner allows adjacent roadway barriers 10 to be positioned at angles relative to each other, which in turn allows a plurality of roadway barriers 10 to form a curved line while the adjacent barriers 10 remain attached to each other, as shown in FIGS. 4*a* and 4*c*. In one embodiment, the pyramidal surface of first end 20 is at an angle 36 of about 10 degrees from a plane that is generally orthogonal to impact surface 16. In this embodiment, roadway barriers 10 that are coupled together may form a circle having a radius of about 65 feet. The angle 36 of this surface is not limited to 10 degrees but may vary between about 1 degree and about 60 degrees. As the angle increases, the radius decreases. Positioning the key at apex 32 enables the key to remain within a keyway in an adjacent roadway barrier 10.

In one embodiment, apex 32 is located closer to impact surface 16 of roadway barrier 10 than to a surface 34 of roadway barrier 32 that is generally parallel to impact surface 16 and opposite to impact surface 16. Positioning apex 32 in this manner and positioning the key within apex 32 produces relatively little gap 33 between adjacent roadway barriers 10 regardless of whether the roadway barriers 10 are positioned in a straight line, a convex formation, as shown in FIG. 4*a*, or a concave formation, as shown in FIG. 4*c*. By having little gap 33 between adjacent roadway barriers 10, vehicles that strike roadway barriers 10 are redirected back onto a roadway without being subjected to sharp corners of roadway barriers 10 that are capable of producing erratic results.

Roadway barrier 10 may also include a support bracket 38 for transferring forces received by a roadway barrier 10 from a vehicle to adjacent roadway barriers 10. More specifically, support bracket 38 can transfer tensile forces generally parallel to elongated body 12 to adjacent roadway barriers 10. Support bracket 38 may be formed from an angle bracket, as shown in FIG. 1. In one embodiment, support bracket 38 is formed of a metal, such as, but not limited to, steel. Support bracket 38 may be coupled to roadway barrier 10 using a mechanical attachment device, which may include, but is not limited to, bolts or anchors that protrude from support bracket 38 and are installed in roadway barrier 10 while roadway barrier 10 is constructed. In one embodiment, support bracket 38 is coupled to elongated body 12 and to leg 14.

Support bracket 38 may also include one or more support arms 42 for coupling adjacent roadway barriers 10 together and for transferring forces generally parallel to elongated body to adjacent roadway barriers 10. Support arms 42 include one or more orifices 44 or slots for receiving a support member 46. Orifices 44 may have a diameter substantially larger than the diameter of support member 46 so that support member 46 may be installed in orifice 44 when adjacent roadway barriers 10 are misaligned. Sizing orifice 44 is this manner reduces the amount of time needed to couple adjacent roadway barriers 10 together.

Support member 46 is sized and configured to be coupled to support arms 42 and to transfer forces between support arms. In one embodiment, support member 46 is a rod having threaded portions at each end, and may have threads throughout the entire length of the rod. After roadway barriers 10 are positioned, support member 46 is attached to support arms 42 by threading a nut onto each end of support member 46 and tightening the nuts. Support members 46 transfer tension forces between adjacent roadway barriers, not compression forces. Instead, compression forces are transferred to adjacent barriers 10 when adjacent barriers contact each other at, for instance, apex 32.

Figure 2:
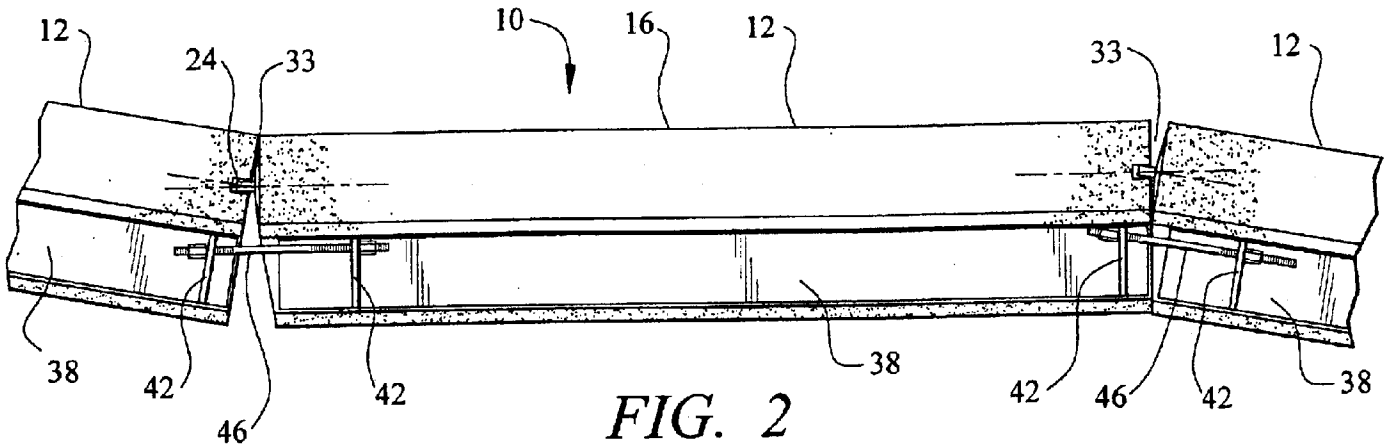
FIG. 2 is a top view of a plurality of roadway barriers of FIG. 1 coupled together and positioned at angles relative to each other.
Figure 3:
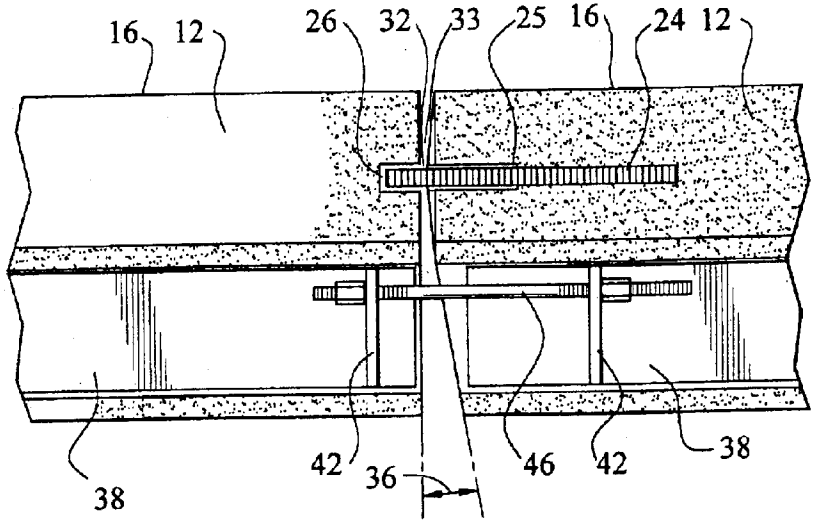
FIG. 3 is a top view of two roadway barriers coupled together.

In one embodiment, support member 46 includes at least two support arms 42. A first support arm 42 is positioned proximate to the first end 20, and a second support arm 42 is positioned proximate to the second end 22. The support bracket 38 may extend from the first end 20 of the roadway barrier 10 to the second end 22 of the roadway barrier 10. In at least one embodiment, as shown in FIG. 2, support arm 42 is positioned close to an end of roadway barrier 10. By positioning support arm 42 close to the end of roadway barrier 10, adjacent roadway barriers 10 may be placed at greater angles relative to each other without support member 46 contacting body 12 and preventing roadway barrier 10 from further rotation. As support arms 42 are placed closer to the ends of adjacent roadway barriers, the angle between adjacent barriers increases. Likewise, as orifice 44 is moved further from body 12, the angle between adjacent barriers increases. Thus, positioning support arms and orifices 44 on roadway barrier 10 can control the degree of rotation available between adjacent roadway barriers 10.

Roadway barrier 10 may include a recess 48 enabling the roadway barrier 10 to be moved. Recess 48 is sized to accommodate forks from a conventional fork lift so that a fork lift can lift roadway barrier 10 without damaging roadway barrier 10. Recess 48 may be a single slot or may be two or more slots.

In one embodiment, roadway barrier 10 has an overall height of between about 1 foot and about 3 feet, and more specifically, roadway barrier 10 may have an overall height of about 18 inches as measured from bottom surface 18 to top surface 28. Configuring roadway barrier 10 in this manner increases the field of view for drivers of most vehicles, thereby making use of roadway barrier 10 safer. Roadway barrier 10 may come in varying lengths and widths. In one embodiment, roadway barrier 10 may be a continuous flexible concrete structure that weighs about 5,000 pounds and is 12 feet long and 2 foot 3 inches wide. In other embodiments, roadway barrier 10 may weigh between about 3,500 pounds and about 6,500 pounds. Roadway barrier may have a height to width ratio of about 2 to 3. Because each barrier has only moderate weight or mass relative to an impacting vehicle, successful redirection of a vehicle depends on using the inertial resistance of each roadway barrier 10 taken collectively. By maintaining flexural continuity between adjacent roadway barriers 10, the inertial resistance and stiffness of several roadway barriers 10 acting together to redirect vehicles onto a road surface.

Roadway barriers 10 may or may not be coupled to the ground during use. Regardless, it is not necessary to attach a roadway barrier 10 to the ground for the barrier 10 to function properly by redirecting vehicles back onto a roadway.

Experimental Results

Roadway barrier 10 was tested in accordance with the National Cooperative Highway Research Program (NCHRP) Report 350, level 2 specifications. Using fifteen roadway barriers 10 connected end to end in a straight line, a 2,000 kilogram pickup truck driven into a roadway barrier 10 at 25 degrees from the impact surface 16 of the roadway barrier 10. while traveling 45 miles per hour. The pick-up truck was successfully redirected back onto the roadway and did not rollover. The pick-up was subjected to a roll angle of about 20.4 degrees. The roadway barrier deflected only 9.1 inches without a barrier-to-roadway anchor. A similar test was also conducted using an 820 kilogram compact car impacting a roadway barrier system at an angle of about 20 degrees and a speed of 45 mph. The barrier passed the small car test with minimal roll angle and a lateral deflection of about 3.2 inches.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A portable roadway barrier, comprising:

an elongated body having an impact surface, a bottom surface, a first end, and a second end;

a first structure at the first end for transferring component forces generally orthogonal to the elongated body from the roadway barrier to adjacent barriers and for transferring component compressive forces generally parallel to the elongated body to adjacent barriers; and a second structure at the first end for coupling the roadway barrier to at least one adjacent roadway barrier and for transferring component tensile forces generally parallel to the elongated body to adjacent barriers;

wherein the first structure is positioned between the second structure and the impact surface.

2. The portable roadway barrier of claim 1, further comprising a support connected to the elongated body for providing additional support during a collision between a vehicle and the barrier.

3. The portable roadway barrier of claim 1, wherein the second structure comprises a support bracket.

4. The portable roadway barrier of claim 3, wherein the support bracket extends from a first end of the elongated body to a second end of the elongated body.

5. The portable roadway barrier of claim 3, further comprising a first support arm coupled to the support bracket near the first end, wherein the first support arm comprises at least one orifice for receiving a support member.

6. The portable roadway barrier of claim 1, wherein the first structure comprises at least one keyway coupled to the first end of the elongated body.

7. The portable roadway barrier of claim 6, wherein the at least one keyway extends from a top surface of the elongated body in a generally downward vertical direction towards the bottom surface.

8. The portable roadway barrier of claim 1, wherein the first structure comprises at least one key coupled to the first end of the elongated body and capable of being inserted into a keyway so that the key may be permitted to rotate vertically and laterally and prevented from moving laterally.

9. The portable roadway barrier of claim 8, wherein the at least one key is a shear pin.

10. The portable roadway barrier of claim 1, wherein the first end comprises a convex surface, and the first structure is coupled to a pinnacle of the convex surface.

11. The portable roadway barrier of claim 10, wherein the convex surface is pyramidal.

12. The portable roadway barrier of claim 10, wherein the convex surface is conical.

13. The portable roadway barrier of claim 10, wherein the elongated body comprises a height between a top surface and the bottom surface between about one foot and about three feet.

14. The portable roadway barrier of claim 1, wherein a ratio between height between the bottom surface and a top surface and width of the bottom surface is about 2 to 3.

15. A portable roadway barrier system, comprising:

at least two roadway barriers coupled together, wherein each roadway barrier comprises:

an elongated body having an impact surface, a bottom surface, a first end, and a second end;

a first structure coupled to the first end for transferring component forces generally orthogonal to the elongated body from the roadway barrier to adjacent barriers and for transferring component compressive forces generally parallel to the elongated body to adjacent barriers; and a second structure coupled to the first end for coupling the roadway barrier to at least one adjacent roadway barrier and for transferring component tensile forces generally parallel to the elongated body to adjacent barriers;

wherein the first structure is positioned between the second structure and the impact surface.

16. The portable roadway barrier of claim 15, wherein the first structure comprises at least one keyway coupled to the first end of the elongated body.

17. The portable roadway barrier of claim 16, wherein the at least one keyway extends from a top surface of the elongated body in a generally downward vertical direction towards the bottom surface.

18. The portable roadway barrier of claim 17, wherein the at least one keyway extends from the bottom surface to the top surface of the elongated body.

19. The portable roadway barrier of claim 15, wherein the first structure comprises at least one key coupled to the first end and capable of being inserted into a keyway so that the key may be permitted to rotate vertically and laterally and prevented from moving laterally.

20. The portable roadway barrier of claim 19, wherein the key comprises a shear pin.

21. The portable roadway barrier of claim 19, wherein the key is coupled to the first end closer to the impact surface than to the surface generally opposite the impact surface.

22. The portable roadway barrier of claim 15, wherein the first end comprises a convex surface, and the first structure is coupled to a pinnacle of the convex surface.

23. The portable roadway barrier of claim 22, wherein the convex surface is pyramidal.

24. The portable roadway barrier of claim 22, wherein the convex surface is conical.

25. The portable roadway barrier of claim 15, further comprising at least one support arm coupled to the elongated body, wherein the first support arm comprises at least one orifice for receiving a support member.

26. The portable roadway barrier of claim 25, wherein the at least one support member comprises a rod.

27. The portable roadway barrier of claim 15, wherein the elongated body comprises a height between a top surface and the bottom surface between about one foot and about three feet.

28. The portable roadway barrier of claim 15, wherein a ratio between height between the bottom surface and a top surface and width of the bottom surface is about 2 to 3.

29. A portable roadway barrier, comprising:

an elongated body having an impact surface, a bottom surface, a first end, and a second end;

at least one pin coupled to the elongated body proximate to the first end for transferring component forces generally orthogonal to the elongated body from the roadway barrier to at least one adjacent barrier and for transferring component compressive forces generally parallel to the elongated body to adjacent barriers;

a support bracket positioned proximate to the first end for coupling the roadway barrier to another roadway barrier and for transmitting component tensile forces generally parallel to the elongated body to adjacent barriers, the support bracket having at least one orifice for receiving a rod configured to couple the support bracket to another roadway barrier; and wherein the at least one pin is positioned between the support bracket and the impact surface on the first end so that the portable roadway barrier may instantaneously engage an adjacent barrier when a vehicle contacts the impact surface and the portable roadway barrier may be coupled to an adjacent barrier.

30. The portable roadway barrier of claim 29, wherein the orifice in the support bracket has a diameter larger than an outside dimension of the rod so that the orifice may receive the rod when the roadway barrier and another roadway barrier are misaligned.

31. The portable roadway barrier of claim 29, wherein the first end comprises a convex surface having a pinnacle, wherein the at least one pin extends from the pinnacle.

32. The portable roadway barrier of claim 29, further comprising at least one keyway coupled to the second end of the elongated body.

33. The portable roadway barrier of claim 32, wherein the at least one keyway extends from a top surface of the elongated body in a generally downward vertical direction towards the bottom surface.

* * * * *